US008693927B2

(12) United States Patent
Morita

(10) Patent No.: US 8,693,927 B2
(45) Date of Patent: Apr. 8, 2014

(54) DEVELOPER CASE AND IMAGE FORMING APPARATUS TO WHICH DEVELOPER CASE IS APPLIED

(75) Inventor: Takashi Morita, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 79 days.

(21) Appl. No.: 13/445,494

(22) Filed: Apr. 12, 2012

(65) Prior Publication Data

US 2012/0263496 A1 Oct. 18, 2012

(30) Foreign Application Priority Data

Apr. 15, 2011 (JP) ..... 2011-091258
Feb. 10, 2012 (JP) ..... 2012-026991

(51) Int. Cl.
*G03G 15/08* (2006.01)

(52) U.S. Cl.
USPC ..... 399/263; 399/119; 399/120; 399/262

(58) Field of Classification Search
USPC ..... 399/119, 120, 262, 263
See application file for complete search history.

(56) References Cited

U.S. PATENT DOCUMENTS 5,083,166 A * 1/1992 Hill et al. ..... 399/119
5,185,631 A * 2/1993 Shibata ..... 399/263
2001/0046395 A1* 11/2001 Ashikari et al. ..... 399/262
2008/0240772 A1 10/2008 Nishikawa
2009/0092419 A1 4/2009 Iwata et al.
2011/0262188 A1 10/2011 Awano

FOREIGN PATENT DOCUMENTS

EP 0475332 3/1992
JP 2003287948 10/2003
JP 2006-251067 9/2006

OTHER PUBLICATIONS

European Search Report 12164066.8 dated Sep. 4, 2012, 6 pages.

* cited by examiner

*Primary Examiner* — David Gray
*Assistant Examiner* — Thomas Giampaolo, II
(74) *Attorney, Agent, or Firm* — K&L Gates LLP

(57) ABSTRACT

A developer case that contains developer and supplies the developer to another device in a specified replenishing position includes a main body and a rotating unit. The main body includes a bottom wall, a top wall, and first and second side walls. The rotating unit includes a rotation shaft, a transportation member, and a drive input member. The first and second side walls respectively have first and second linear inner surfaces. When the developer case is in the replenishing position, when a line perpendicular to a horizontal line that passes through an axis of the rotation shaft is defined as a reference line, a first angle θ1 formed between the reference line and the first linear inner surface is less than a second angle θ2 formed between the reference line and the second linear inner surface.

15 Claims, 12 Drawing Sheets

DEVELOPER CASE AND IMAGE FORMING APPARATUS TO WHICH DEVELOPER CASE IS APPLIED

INCORPORATION BY REFERENCE

This application is based upon and claims the benefit of priority from the corresponding Japanese Patent application Nos. 2011-091258 and 2012-026991, respectively filed on Apr. 15, 2011 and Feb. 10, 2012, the entire contents of which are incorporated herein by reference.

BACKGROUND

The present disclosure relates to a developer case that stores developer, and an image forming apparatus to which the developer case is mounted.

A toner container (developer case) is used for storing toner (developer). A developing device is replenished with toner in the container. The toner container is removably mounted in an image forming apparatus. The toner container typically includes a main body, a toner discharge port, a transportation screw, and an agitating paddle. The main body has an area in which the toner is stored. The toner discharge port is provided at an appropriate position in a bottom wall of the main body. The transportation screw transports the toner toward the toner discharge port. And the agitating paddle agitates the toner in the main body.

Preferably, the capacity of the main body is increased while the toner can be discharged through the toner discharge port without toner being left in the main body. However, in related-art toner containers, the toner is left on the bottom wall and in corners of the main body. Thus, there has been a problem in that toner in the main body is not completely discharged.

SUMMARY

A developer case according to an embodiment of the present disclosure is provided that contains developer and supplies the developer to another device in a specified replenishing position. The developer case includes a main body that includes a bottom wall, a top wall, a first side wall, and a second side wall. The first and second side walls connect end portions of the bottom wall to corresponding end portions of the top wall. The developer case also includes a rotating unit that is located on the bottom wall in the main body and transports the developer. The rotating unit includes a rotation shaft that extends in a direction in which the bottom wall extends, a transportation member positioned in an outer circumference of the rotation shaft and rotating together with the rotation shaft, and a drive input member to which a drive force that rotates the rotation shaft in a specified rotation direction about an axis is inputted. In the developer case, in a section perpendicular to the rotation shaft, the bottom wall has an inner surface having a semi-circular shape corresponding to a locus of rotation of a radially furthest protruding portion of the transportation member. The first side wall and the second side wall, respectively, have a first linear inner surface and a second linear inner surface which linearly extend in an up-down direction. In the developer case, in the section perpendicular to the rotation shaft, the first linear inner surface and the second linear inner surface each extend upward along a tangent line of the semi-circular inner surface of the bottom wall. Also, in the section perpendicular to the rotation shaft, the first side wall is positioned on an upstream side in a rotation direction of the rotating unit, the second side wall is positioned on a downstream side in the rotation direction of the rotating unit, and the distance between the first linear inner surface and the second linear inner surface increases from the bottom wall side toward an upper portion of the main body. Moreover, in the section perpendicular to the rotation shaft, when the developer case is in the replenishing position, a first angle θ1 formed between a reference line and the first linear inner surface is less than a second angle θ2 formed between the reference line and the second linear inner surface where a line perpendicular to a horizontal line that passes through the axis of the rotation shaft is defined as the reference line.

An image forming apparatus according to another embodiment of the present disclosure is provided that includes an image carrying body, that carries a developer image on a circumferential surface thereof, a developing device that supplies developer to the image carrying body, and a developer case removably connected to the developing device. The developing device is replenished with the developer from the developer case. The developer case includes a main body that includes a bottom wall, a top wall, a first side wall, and a second side wall. The first and second side walls connect end portions of the bottom wall to corresponding end portions of the top wall. The developer case also includes a rotating unit that is located on the bottom wall in the main body and transports the developer. The rotating unit includes a rotation shaft that extends in a direction in which the bottom wall extends, a transportation member positioned in an outer circumference of the rotation shaft and rotating together with the rotation shaft, and a drive input member to which a drive force that rotates the rotation shaft in a specified rotation direction about an axis is inputted. In the developer case, in a section perpendicular to the rotation shaft, the bottom wall has an inner surface having a semi-circular shape corresponding to a locus of rotation of a radially furthest protruding portion of the transportation member. The first side wall and the second side wall respectively have a first linear inner surface and a second linear inner surface which linearly extend in an up-down direction. In the developer case, in the section perpendicular to the rotation shaft, the first linear inner surface and the second linear inner surface each extend upward along a tangent line of the semi-circular inner surface of the bottom wall. Also, in the section perpendicular to the rotation shaft, the first side wall is positioned on an upstream side in a rotation direction of the rotating unit, the second side wall is positioned on a downstream side in the rotation direction of the rotating unit, and a distance between the first linear inner surface and the second linear inner surface increases from the bottom wall side toward an upper portion of the main body. Moreover, in the section perpendicular to the rotation shaft, when the developer case is in a replenishing position where the developer case supplies the developer to the developing device, a first angle θ1 formed between a reference line and the first linear inner surface is less than a second angle θ2 formed between the reference line and the second linear inner surface where a line perpendicular to a horizontal line that passes through the axis of the rotation shaft is defined as the reference line.

Additional features and advantages are described herein, and will be apparent from the following Detailed Description and the figures.

BRIEF DESCRIPTION OF THE FIGURES

FIG. 7 is a perspective view of the toner container viewed from a direction that is inverted by 180 degrees from a direction from which FIG. 6 is viewed;

DETAILED DESCRIPTION

Figure 1:
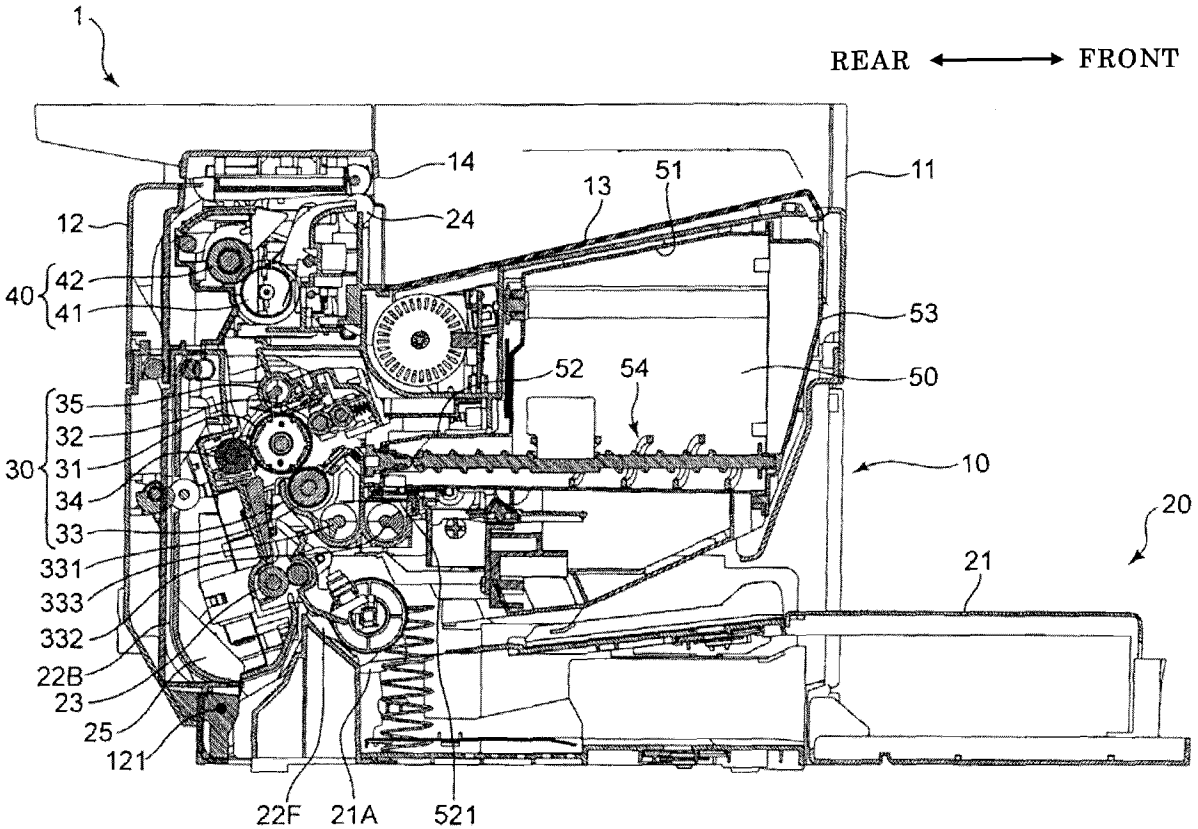
FIG. 1 is a sectional view illustrating an internal structure of an image forming apparatus according to an embodiment of the present disclosure.

An embodiment of the present disclosure will be described below with reference to the drawings. FIG. 1 is a sectional view illustrating an internal structure of an image forming apparatus 1 according to an embodiment of the present disclosure. Although a monochrome printer is described as an example of the image forming apparatus 1 below, the image forming apparatus may be a copying machine, a facsimile machine, a multi-function peripheral having these functions, or an image forming apparatus that forms color images.

The image forming apparatus 1 includes a main body housing 10, a sheet feed unit 20, an image forming unit 30, a fixing unit 40, and a toner container 50 (developer case). The main body housing 10 has a substantially box-shaped housing structure and houses the sheet feed unit 20, the image forming unit 30, the fixing unit 40, and the toner container 50 therein.

The main body housing 10 includes a front cover 11 on a front surface side thereof (right side in FIG. 1) and a rear cover 12 on a rear surface side thereof. A user can open the front cover 11 and remove the toner container 50 from the front surface side of the main body housing 10. The rear cover 12 can be opened when removing a sheet jam or performing maintenance work. The image forming unit 30 and the fixing unit 40 are each removable from the rear surface side of the main body housing 10 when the rear cover 12 is opened. A sheet delivery unit 13 is located on an upper surface of the main body housing 10. A sheet, on which an image has been formed, is delivered to the sheet delivery unit 13.

The sheet feed unit 20 includes a sheet feed cassette 21. Sheets to be subject to an image forming process are loaded in the sheet feed cassette 21. Part of the sheet feed cassette 21 protrudes forward from the main body housing 10. In the sheet feed cassette 21, a sheet loading space, in which a stack of the sheets are loaded, a lift plate that lifts up the stack of sheets for feeding the sheets, and so forth is provided. A sheet pickup unit 21A is positioned above a rear end side of the sheet feed cassette 21. A pickup roller (not shown) is located in the sheet pickup unit 21A. The pickup roller feeds an uppermost sheet of the stack in the sheet feed cassette 21 one after another.

The image forming unit 30 performs an image forming process in which a toner image is formed on the sheet having been fed from the sheet feed unit 20. The image forming unit 30 includes a photoconductor drum 31 (image carrying body) and the following components disposed around the photoconductor drum 31: a charger 32, an exposure unit (not shown in FIG. 1), a developing device 33, a transfer roller 34, and a cleaning device 35.

The photoconductor drum 31 rotates about the axis thereof. An electrostatic latent image and a toner image (developer image) are formed on a circumferential surface of the photoconductor drum 31. The photoconductor drum 31 uses a photoreceptor drum formed of an amorphous silicon (a-Si)-based material or the like. The charger 32, which includes a charging roller that contacts the photoconductor drum 31, uniformly charges the surface of the photoconductor drum 31. The exposure unit includes a laser light source and optical system components such as a mirror and a lens. The exposure unit emits light, which has been modulated in accordance with image data received from external devices such as a personal computer, so as to form an electrostatic latent image on the circumferential surface of the photoconductor drum 31.

The developing device 33 supplies toner (developer) onto the circumferential surface of the photoconductor drum 31 so as to form the toner image by developing the above-described electrostatic latent image on the photoconductor drum 31. The developing device 33 includes a developing roller 331, a first transportation screw 332, and a second transportation screw 333. The developing roller 331 carries the toner to be supplied to the photoconductor drum 31. The first transportation screw 332 and the second transportation screw 333 transport the toner in a circulating manner while agitating the toner inside a developing housing 60 (see FIGS. 2 to 5). The details of the developing device 33 will be described hereinafter.

The transfer roller 34 transfers the toner image formed on the circumferential surface of the photoconductor drum 31 onto the sheet. The transfer roller 34 and the photoconductor drum 31 form a transfer nip therebetween. A transfer bias, the polarity of which is opposite to that of the toner, is applied to the transfer roller 34. The cleaning device 35 includes a cleaning roller and the like and cleans the circumferential surface of the photoconductor drum 31 after the toner image has been transferred.

The fixing unit 40 performs a fixing process in which the transferred toner image is fixed onto the sheet. The fixing unit 40 includes a fixing roller 41 and a pressure roller 42. The fixing roller 41 includes a heat source thereinside, and the pressure roller 42 is pressed against the fixing roller 41. The fixing roller 41 and the pressure roller 42 form a fixing nip therebetween. When the sheet onto which the toner image has been transferred is passed through the fixing nip, the toner image is fixed onto the sheet by heat from the fixing roller 41 and a pressure applied by the pressure roller 42.

The toner container 50 stores the toner, with which the developing device 33 is replenished. The toner container 50 includes a main body 51, a cylindrical portion 52, a lid member 53, and a rotating unit 54. The main body 51 defines the storage space for the toner. The cylindrical portion 52 protrudes from a lower portion of a surface of one side (rear surface in FIG. 1) of the main body 51. The lid member 53 covers the other side of the main body 51. The rotating unit 54 transports toner stored in the toner container 50. When the rotating unit 54 rotates, the toner stored in the toner container 50 is supplied to the developing device 33 through a toner discharge port 521 (discharge port), which is located at an end of a lower surface of the cylindrical portion 52. The details of the toner container 50 will be described hereinafter with reference to FIGS. 6 to 12.

In order to transport sheets, a main transportation path 22F and an inversion transportation path 22B are formed in the main body housing 10. The main transportation path 22F extends from the sheet pickup unit 21A of the sheet feed unit 20 through the image forming unit 30 and the fixing unit 40 to a sheet delivery port 14, which is formed so as to oppose the sheet delivery unit 13 on the upper surface of the main body housing 10. The inversion transportation path 22B returns a sheet, on one side of which an image has been printed, toward an upstream side of the image forming unit 30 in the main transportation path 22F. The inversion transportation path 22B is used when printing is performed on both sides of a sheet.

A registration roller pair 23 is located upstream relative to the transfer nip formed between the photoconductor drum 31 and the transfer roller 34 in the main transportation path 22F. The registration roller pair 23 momentarily stops the sheet, corrects the skew of the sheet, and then feeds the sheet toward the transfer nip at a timing specified for image transfer. A plurality of transportation rollers for transporting a sheet are located at appropriate positions along the main transportation path 22F and the inversion transportation path 22B including, for example, a sheet delivery roller pair 24 disposed near the sheet delivery port 14.

The inversion transportation path 22B is formed between an outer side surface of an inversion unit 25 and an inner surface of the rear cover 12 of the main body housing 10. The transfer roller 34 and one of the rollers of the registration roller pair 23 are attached to an inner side surface of the inversion unit 25. The rear cover 12 and the inversion unit 25 are each pivotable about an axis of the fulcrum point 121. When a sheet jam occurs in the inversion transportation path 22B, the rear cover 12 is opened. When a sheet jam occurs in the main transportation path 22F, or when the photoconductor drum 31 unit or the developing device 33 is removed out of the main body housing 10, the inversion unit 25 is opened in addition to the rear cover 12.

Figure 2:
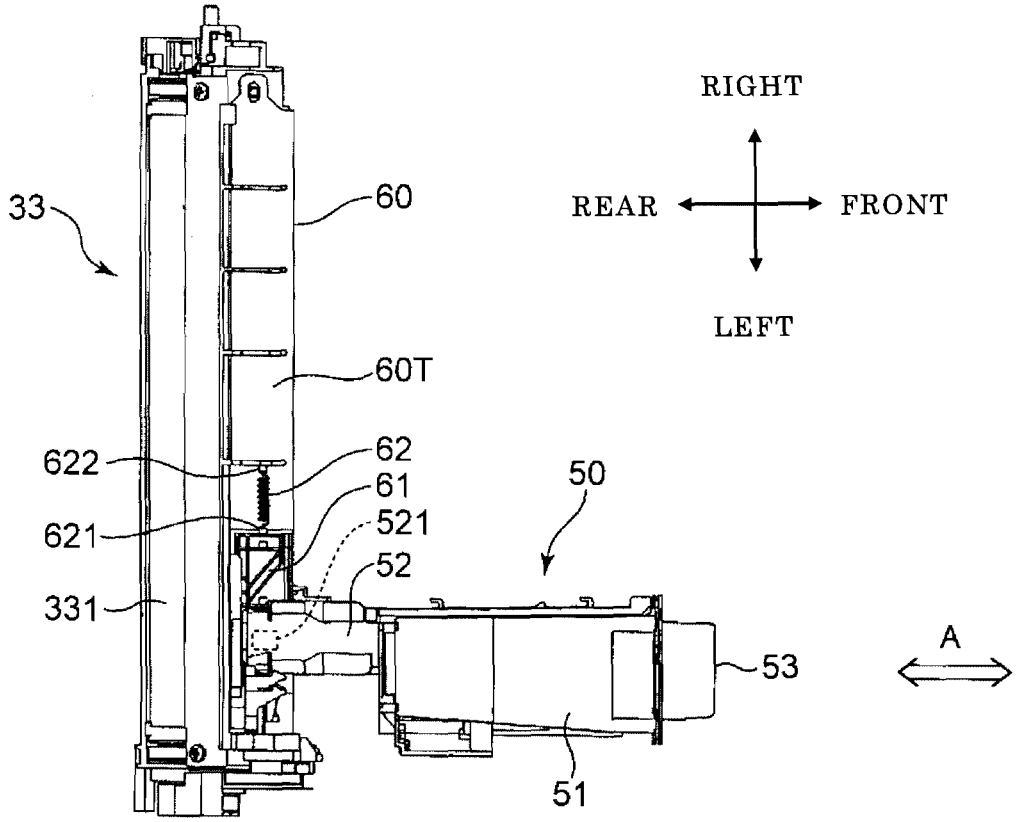
FIG. 2 is a plan view of a developing device and a toner container mounted in the image forming apparatus.
Figure 3:
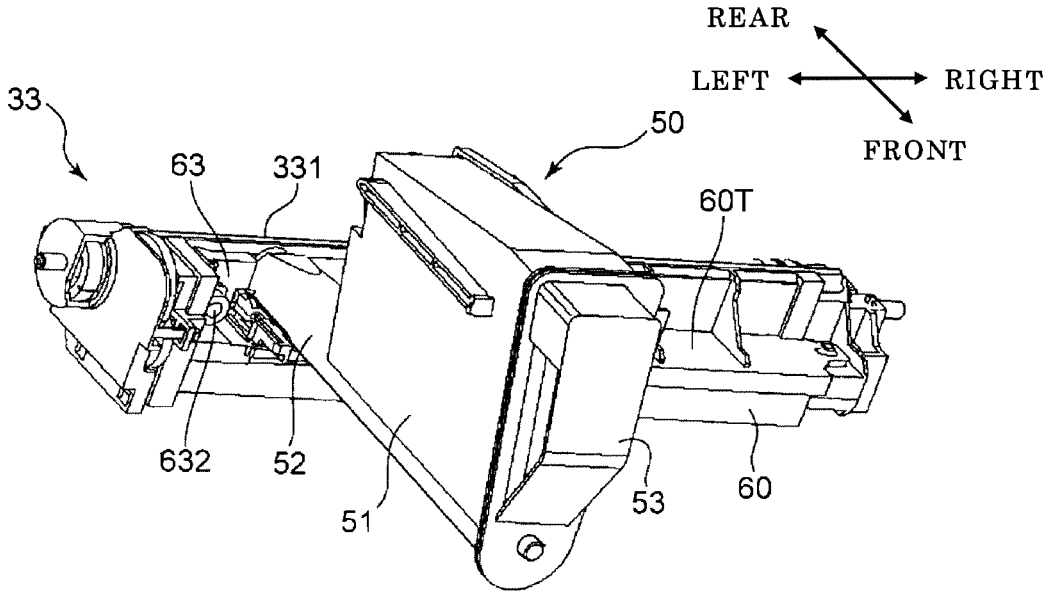
FIG. 3 is a perspective view of the developing device and the toner container illustrated in FIG. 2.
Figure 4:
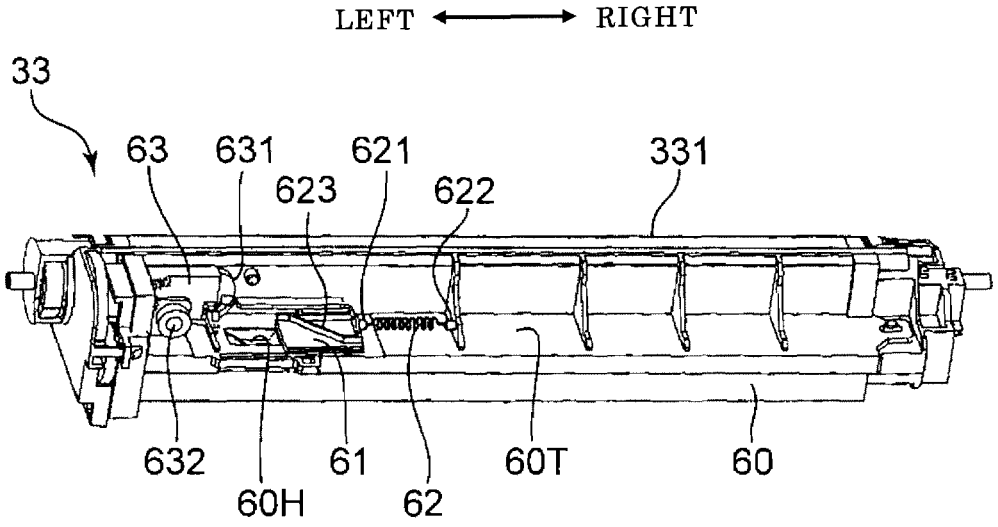
FIG. 4 is a perspective view of the developing device as an individual component.
Figure 5:
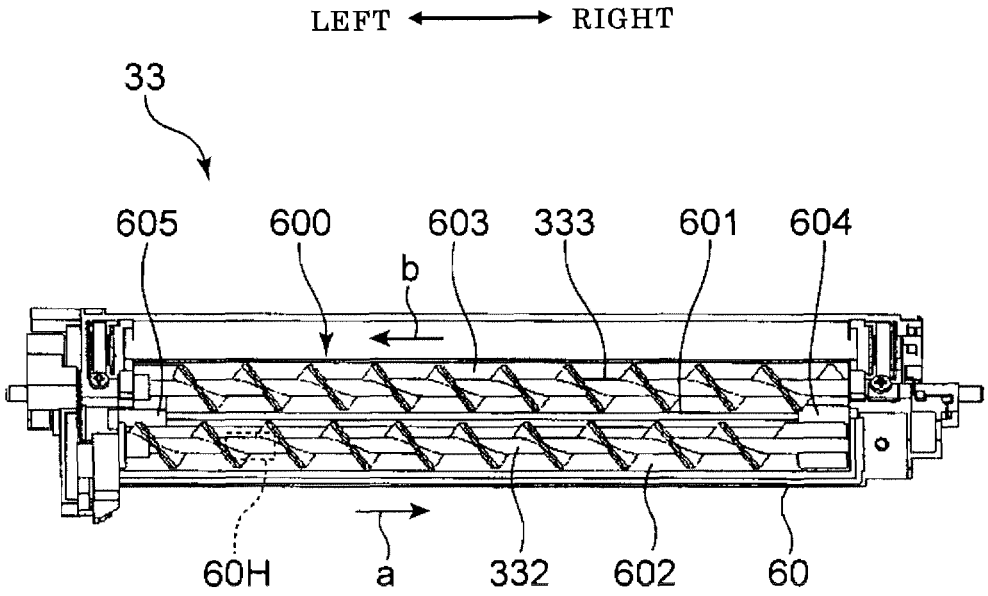
FIG. 5 is a plan view illustrating an internal structure of the developing device.
Figure 6:
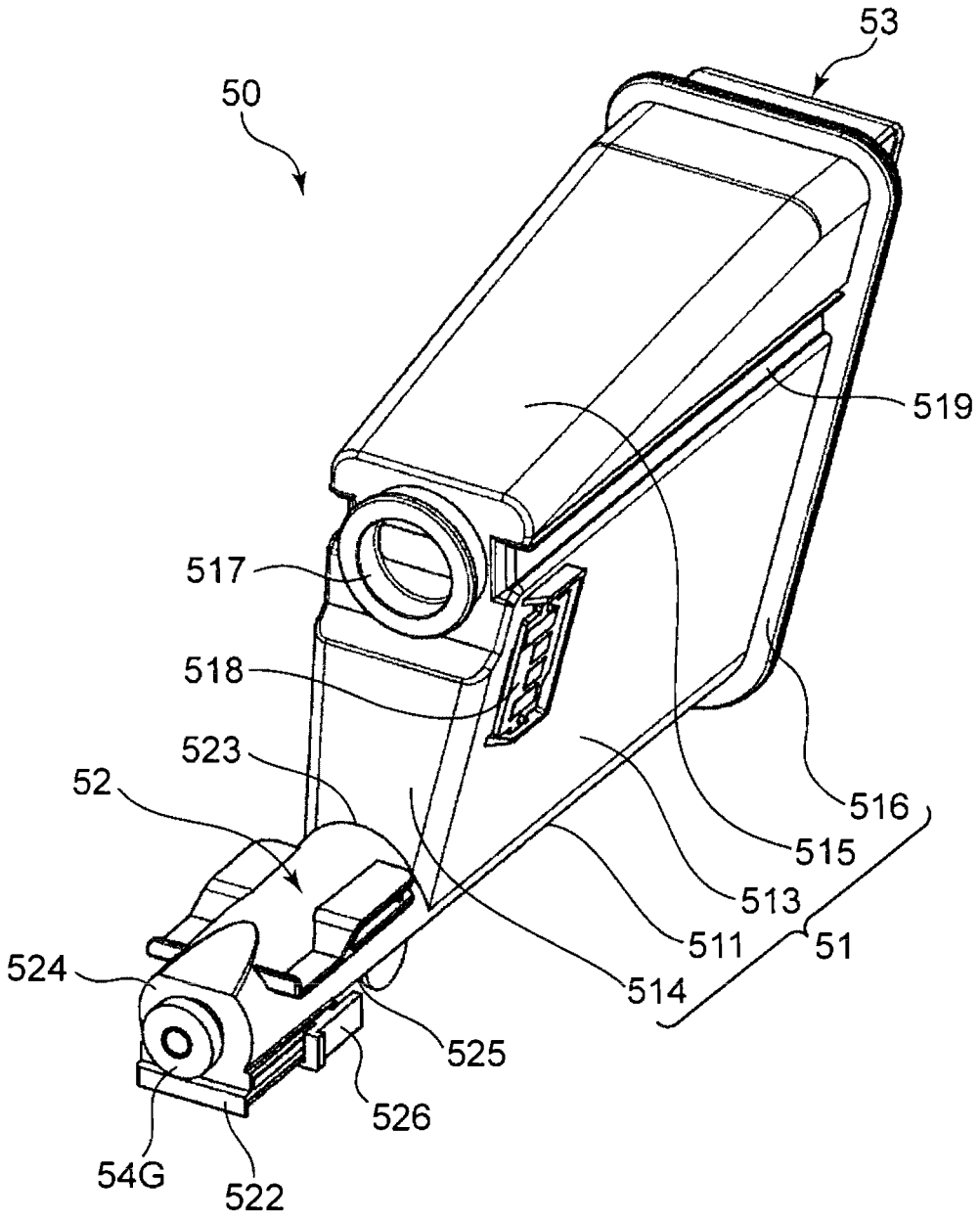
FIG. 6 is a perspective view of the toner container.
Figure 7:
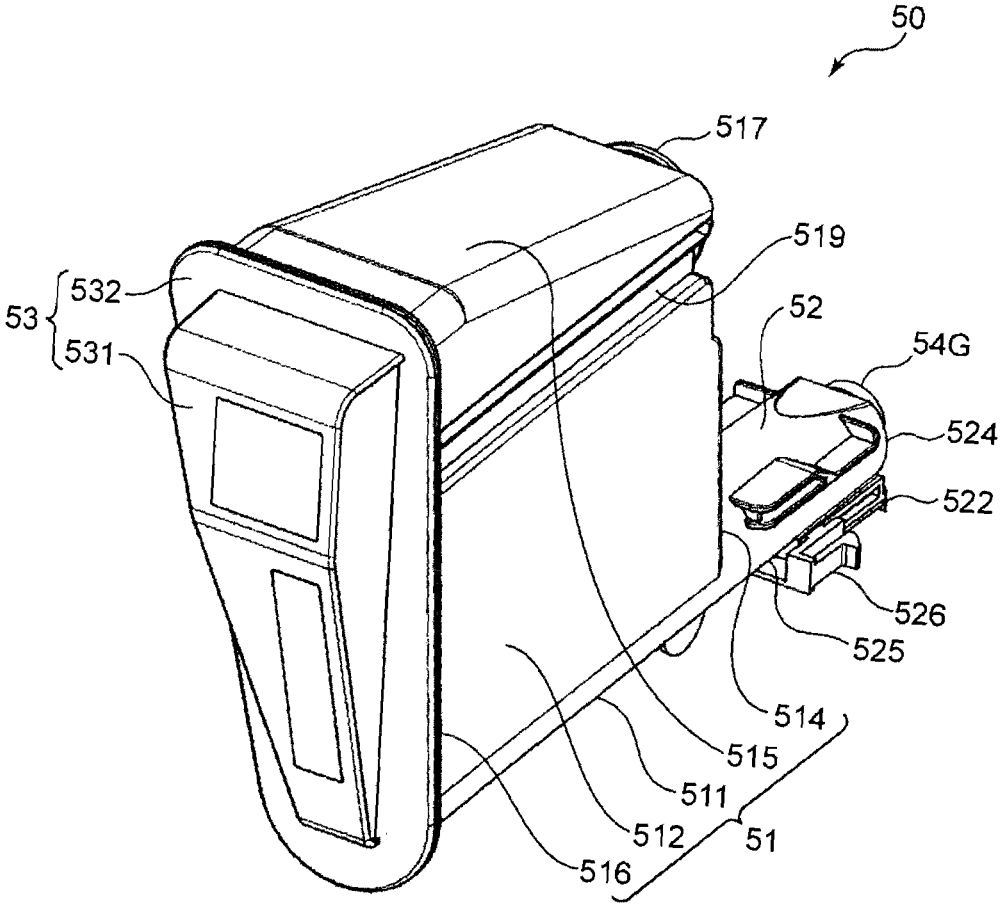

Next, the structures of the developing device 33 and the toner container 50 and the relationship between the developing device 33 and the toner container 50 will be described with reference to FIGS. 2 to 7. FIG. 2 is a plan view illustrating when the developing device 33 and the toner container 50 are connected to each other. FIG. 3 is a perspective view of the state illustrated in FIG. 2. FIG. 4 is a perspective view of the developing device 33 as an individual component. FIG. 5 is a plan view illustrating an internal structure of the developing device 33. FIGS. 6 and 7 are perspective views each illustrating the toner container as an individual component.

The developing device 33 includes the developing housing 60 having an elongated box shape (the axial direction of the developing roller 331). An opening is formed in the developing housing 60 extending in the longitudinal direction of the developing housing 60. Part of a circumferential surface of the developing roller 331 is exposed by the opening. The developing housing 60 according to an embodiment is mounted in the main body housing 10 such that the longitudinal direction of the developing housing 60 matches a left-right direction (first direction) of the main body housing 10.

A toner replenishment port 60H is formed near the left end of a top plate 60T of the developing housing 60. The toner is supplied to the housing from the toner container 50 through the toner replenishment port 60H. The developing device 33 and the toner container 50 are connected to each other such that the toner replenishment port 60H and the toner discharge port 521 of the toner container 50 are superposed with each other in an up-down direction. As indicated by arrow A in FIG. 2, the toner container 50 is connected to or removed from the developing device 33 in a direction (front-rear direction/second direction) perpendicular to the longitudinal direction of the developing housing 60. The housing of the toner container 50 has an elongated shape. Thus, when the toner container 50 is connected to the developing device 33, the combination of the developing device 33 and the toner container 50 form a structure having a substantially L-shape (see FIG. 2).

A developing shutter plate 61, which is slidable in the left-right direction, is located on an upper surface of the top plate 60T. The developing shutter plate 61 is normally urged leftward by an urging spring 62. The urging spring 62 includes a coil spring. Ends of the urging spring 62 are attached to spring seats 621 and 622, which are respectively provided at a right end edge of the developing shutter plate 61 and at a rib adjacent to the developing shutter plate 61. Although the toner replenishment port 60H is open in FIG. 4, when the toner container 50 is not connected, the developing shutter plate 61 is urged by the urging spring 62 so as to be positioned at a left position, thereby closing the toner replenishment port 60H.

A pressure plate 522 is attached below an end edge (the other end portion 524) of the cylindrical portion 52 of the toner container 50. A container gear 54G, which inputs a rotational drive force to the rotating unit 54, is exposed from an end surface of the cylindrical portion 52. A gear holder 63 is located in the developing housing 60 at a rear left position relative to the toner replenishment port 60H. The gear holder 63 includes an input gear 631 and a coupling 632. A rotational drive force from a motor (not shown) provided in the main body housing 10 is imparted to the coupling 632. When the toner container 50 is connected to the developing device 33, the input gear 631 is engaged with the container gear 54G, thereby transmitting the rotational drive force to the container gear 54G.

When the toner container 50 is connected to the developing device 33, the cylindrical portion 52 of the toner container 50 is moved relative to the toner replenishment port 60H from the front to rear. In so doing, the pressure plate 522 of the toner container 50 interferes with the developing shutter plate 61 that closes the toner replenishment port 60H. As a result, the developing shutter plate 61 is moved rightward. Specifically, a diagonal protrusion 623, which protrudes from an upper surface of the developing shutter plate 61, and the pressure plate 522 interfere with each other, thereby pressing the developing shutter plate 61 rightward against an urging force applied by the urging spring 62. When the cylindrical portion 52 of the toner container 50 moves to a specified position, the toner replenishment port 60H is completely opened and the container gear 54G is brought into engagement with the input gear 631.

As illustrated in FIG. 5, the developing housing 60 has an internal space 600. When a two-component development method is used, the internal space 600 is filled with developer including toner and carrier. The carrier is agitated and mixed with the toner in the internal space 600 in order to charge the toner and transported to the developing roller 331. The toner is successively supplied to the developing roller 331 and consumed. The toner container 50 supplies toner as the toner is consumed.

The internal space 600 of the developing housing 60 is separated into a first path 602 and a second path 603, which are both elongated in the left-right direction, by a separator plate 601, which extends in the left-right direction. The separator plate 601 is shorter than the width of the developing housing 60 in the left-right direction. A first communication path 604 and a second communication path 605 are respectively formed at the right and left ends of the separator plate 601. The first communication path 604 and the second communication path 605 allow the first path 602 and the second path 603 to communicate with each other. By doing this, the developing housing 60 defines a circulation path formed by the first path 602, the first communication path 604, the second path 603, and the second communication path 605.

The above-mentioned toner replenishment port 60H is positioned in an upper portion near the left end of the first path 602. The first path 602 contains the first transportation screw 332, and the second path 603 contains the second transportation screw 333. The first and second transportation screws 332 and 333 each have a shaft and a blade member, which protrudes from the circumference of the shaft and has a spiral shape. The first transportation screw 332 rotates about the axis of the shaft, thereby transporting the developer in the direction indicated by arrow a in FIG. 5. The second transportation screw 333 rotates about the axis of the shaft, thereby transporting the developer in the direction indicated by arrow b in FIG. 5.

Rotation of the first and second transportation screws 332 and 333 causes developer to be transported in a circulating manner along the above-described circulation path. The toner with which the developing device 33 is newly replenished through the toner replenishment port 60H falls onto the first path 602, where the toner is mixed with existing developer and transported in the direction indicated by arrow a by the first transportation screw 332. In so doing, the toner is agitated together with the carrier and charged. Then, the toner is moved from a downstream end of the first path 602 through the first communication path 604 to the second path 603 and transported in the direction indicated by arrow b by the second transportation screw 333. While the toner is being transported, the toner is uniformly charged and part of the toner is supplied to the circumferential surface of the developing roller 331. The remaining toner and the carrier are returned to an upstream end of the first path 602 through the second communication path 605. Although the developing device described above is for the two-component development method in the present embodiment, the development method may instead be a one-component development method or other development method.

Figure 8:
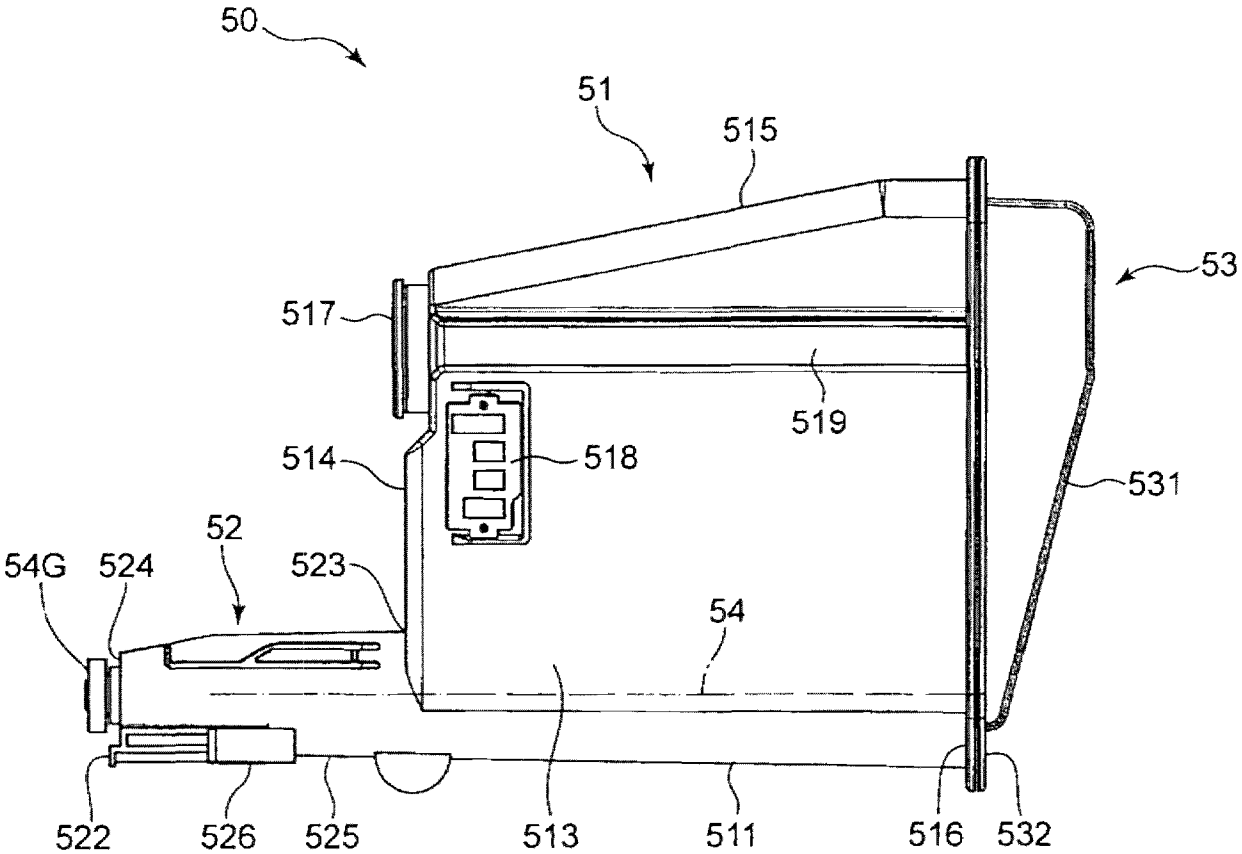
FIG. 8 is a side view of the toner container.
Figure 9:
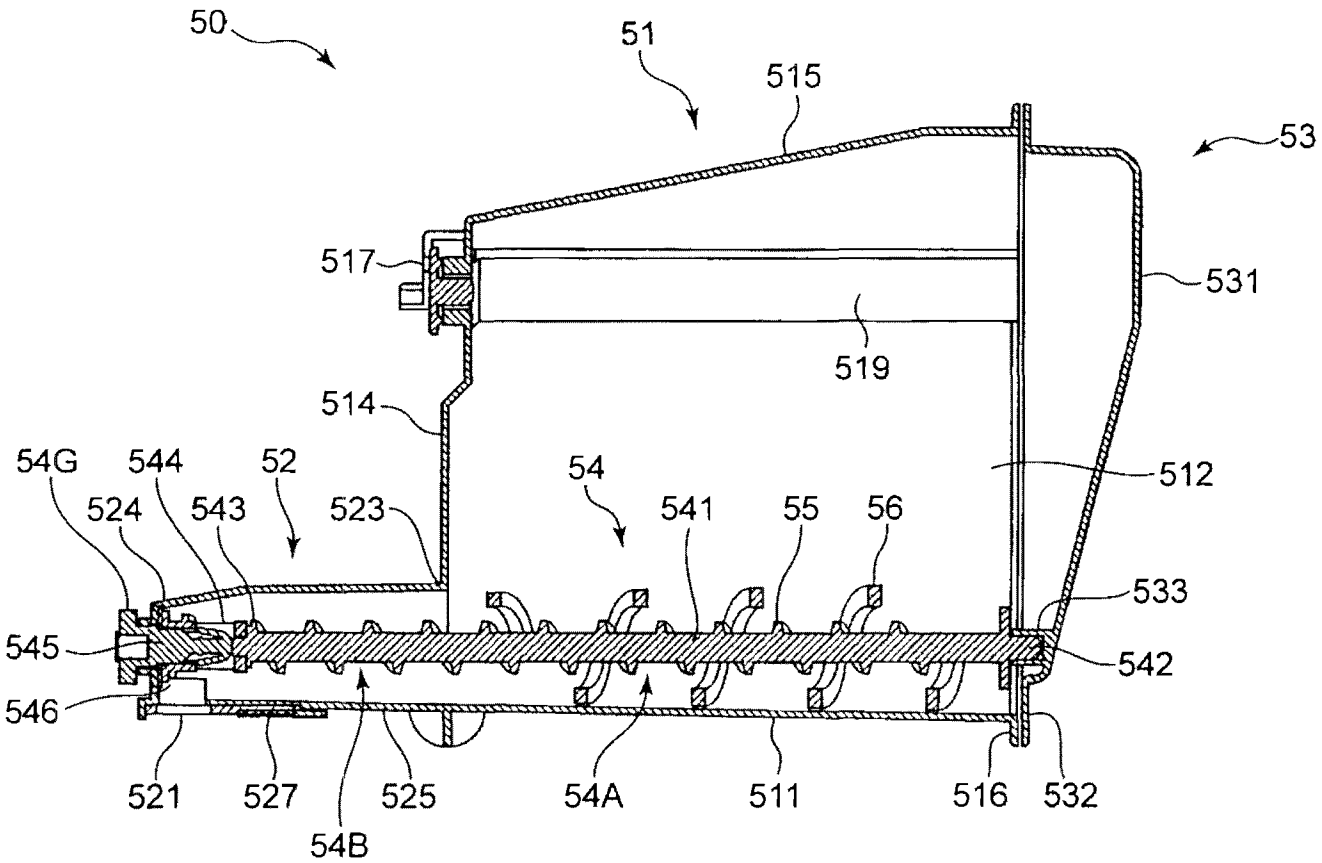
FIG. 9 is a side sectional view of the toner container.
Figure 10:
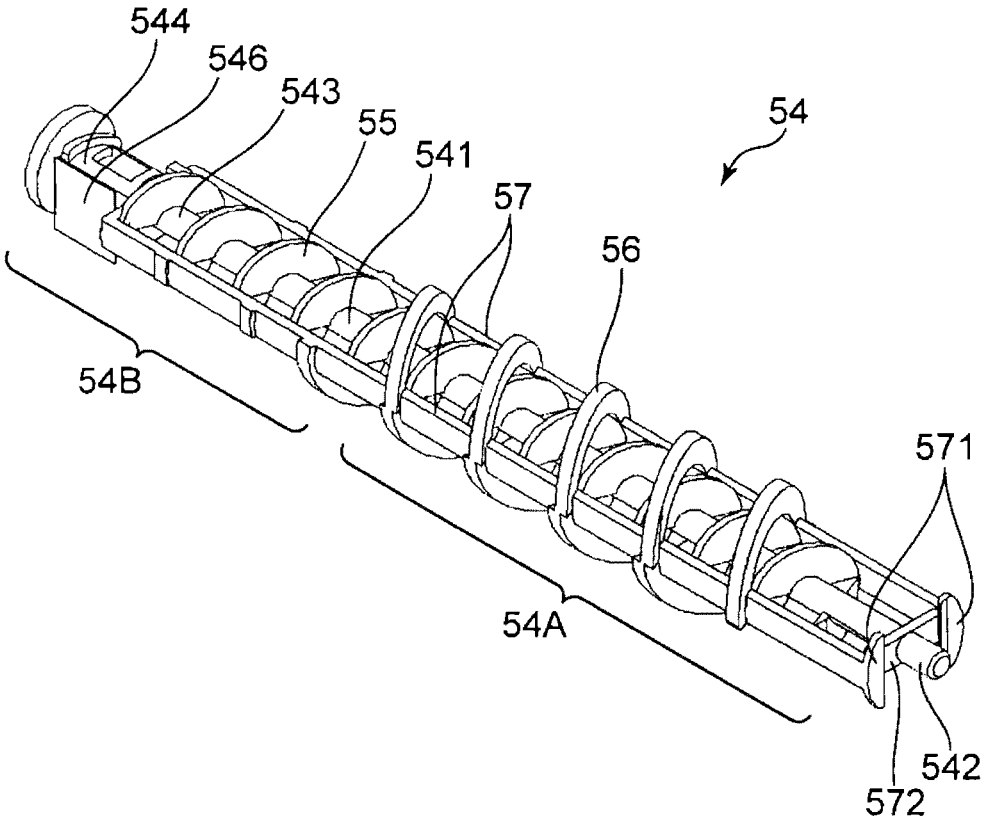
FIG. 10 is a perspective view of a rotating unit located in the toner container.
Figure 11:
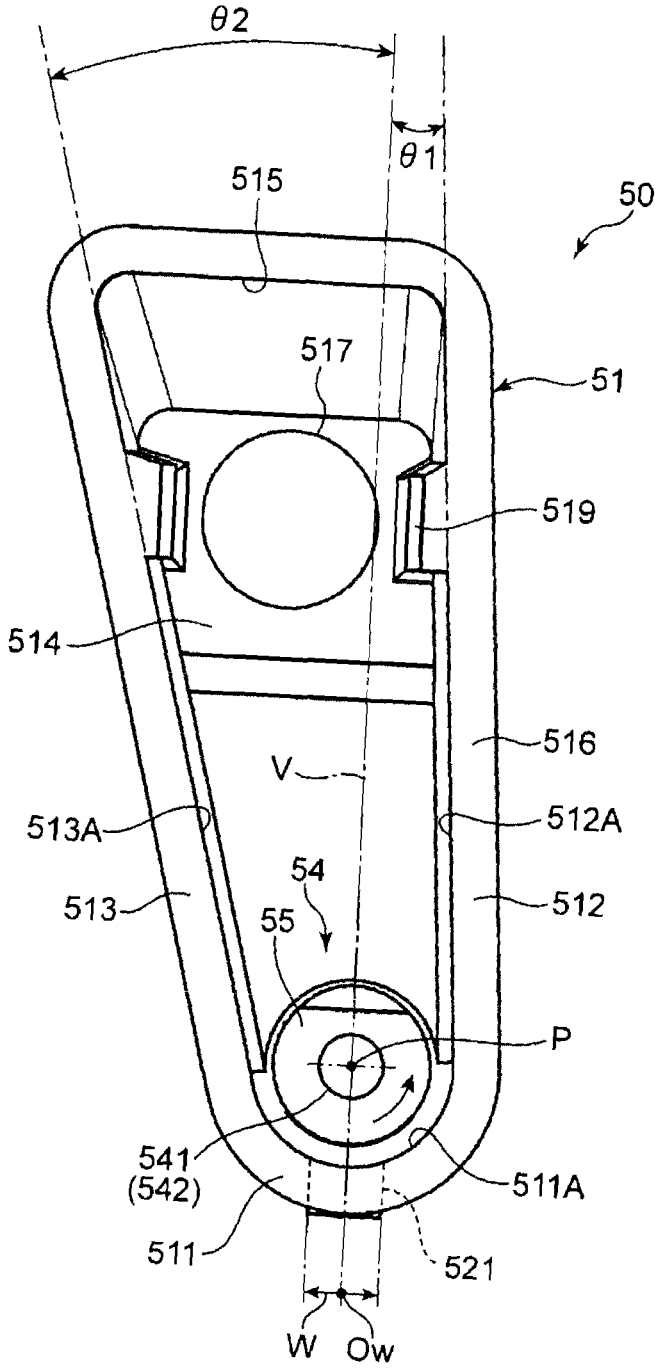
FIG. 11 is a front view of the toner container with a lid member removed.

Next, the structure of the toner container 50 will be described with reference to FIGS. 6 to 11. FIG. 6 is a rear perspective view of the toner container 50 viewed from the cylindrical portion 52 side. FIG. 7 is a perspective view of the toner container 50 illustrated in FIG. 6 viewed from the lid member 53 side, which is a side inverted by 180 degrees from a side from which FIG. 6 is viewed. FIG. 8 is a side view of the toner container 50. FIG. 9 is a side sectional view of the toner container 50. FIG. 10 is a perspective view of the rotating unit 54 located in the toner container 50. FIG. 11 is a front view of the toner container 50 with the lid member 53 removed.

As described above, the toner container 50 includes the main body 51, the cylindrical portion 52, the lid member 53 (fourth side wall), and the rotating unit 54. The main body 51 has a bottom wall 511, a first side wall 512, a second side wall 513, a third side wall 514, a top wall 515, and a first flange portion 516 in order to form a space in which toner is stored. The bottom wall 511 has a semi-circular section. The first side wall 512 extends upward from an end edge of the bottom wall 511. The second side wall 513 extends upward from the other end edge of the bottom wall 511 so as to oppose the first side wall 512. The first side wall 512 and the second side wall 513 are connected to each other with the third side wall 514 therebetween at an end edge portion on the cylindrical portion 52 side. The upper end edges of the first side wall 512 and the second side wall 513 are connected to each other with the top wall 515 therebetween. The first flange portion 516 is formed at an end edge on a side opposing the lid member 53. A side opening is formed in the first flange portion 516 side of the main body 51.

The main body 51 has a vertically elongated external shape, in which the distance between the first side wall 512 and the second side wall 513 increases from the bottom wall 511 toward an upper portion of the main body 51. The first side wall 512 and the second side wall 513 are planar. As illustrated in FIG. 11, the first side wall 512 and the second side wall 513 have inner surfaces, each of which has a linear shape in sectional view.

A cap 517 is attached at an upper portion of the third side wall 514. The cap 517 closes an opening through which the toner, with which the main body 51 is filled, passes. A wireless tag 518 is attached to the second side wall 513. Management information of the toner container 50 is recorded in the wireless tag 518. A pair of grooves 519 are formed near upper end portions of the first side wall 512 and the second side wall 513. Each groove 519 is parallel to a direction in which the bottom wall 511 extends. When the toner container 50 is mounted in the main body housing 10, the grooves 519 are guided by guiding members (not shown) on the main body housing 10 side.

The cylindrical portion 52 is a cylindrical part that protrudes from the third side wall 514 so as to be continuous with the bottom wall 511. One end portion 523 of the cylindrical portion 52 is connected to a lower end portion of the third side wall 514 so as to allow communication between an internal space of the main body 51 and an internal space of the cylindrical portion 52. The other end portion 524 is a protruding end of the cylindrical portion 52. The container gear 54G (drive input member) is positioned so as to extend further than the other end 524. A bottom portion 525 of the cylindrical portion 52 is flush with the bottom wall 511 of the main body 51, thereby forming a portion having a semi-circular shape in sectional view throughout a region from the first flange portion 516 to the other end portion 524. The cylindrical portion 52 has a tapered shape that slightly tapers from the one end portion 523 toward the other end portion 524.

As described above, the cylindrical portion 52 includes the toner discharge port 521 and is attached to the developing device 33. When the cylindrical portion 52 is attached to the developing device 33, an engaging member 526, which is located on the bottom portion 525, engages with part of the developing housing 60. The toner stored in the main body 51 is fed to the cylindrical portion 52 by rotation of the rotating unit 54, which will be described hereinafter, and discharged through the toner discharge port 521.

As illustrated in FIG. 9, the toner discharge port 521 is positioned near the other end portion 524 of the bottom portion 525. A shutter plate 527 is mounted on a lower surface of the toner discharge port 521. The shutter plate 527 slides along in a direction in which the cylindrical portion 52 extends. An urging member (not shown) urges the shutter plate 527 toward the other end portion 524 so as to normally close the toner discharge port 521. When the cylindrical portion 52 is attached to the developing device 33, the shutter plate 527 interferes with part of the developing housing 60, thereby being slid toward the one end portion 523. FIG. 9 illustrates when the shutter plate 527 is slid back so as to open the toner discharge port 521. The shutter plate 527 and the above-mentioned engaging member 526 are integrally formed.

The lid member 53 covers the side opening of the main body 51. The lid member 53 has a recess-shaped lid body 531 and a second flange portion 532 formed on a peripheral edge of the lid body 531. The second flange portion 532 faces and contacts the first flange portion 516. The lid body 531 has an inclined surface, which is inclined so as to bulge from a lower to upper portions thereof, and a perpendicular surface, which is continuous with an upper end of the inclined surface. The perpendicular surface of the lid body 531 considerably protrudes from the second flange portion 532. The user can hold the protruding portion to mount or remove the toner container 50 to or from the main body housing 10. A shaft support portion 533 (second shaft support portion) is provided on a lower end of an inner surface of the lid body 531. A first end portion 542 of a rotation shaft of the rotating unit 54, which will be described hereinafter, is rotatably supported by the shaft support member 533. The second flange portion 532 joins the first flange portion 516 with the first end portion 542 inserted into the shaft support portion 533.

The rotating unit 54 is located above the bottom wall 511 of the main body 51 to the cylindrical portion 52. By rotating the rotating unit 54 about the axis, toner is transported. As illustrated in FIGS. 9 and 10, the rotating unit 54 includes a rotation shaft 541, a first transportation member 55, a second transportation member 56 (transportation members), and a pair of dispersing members 57.

The rotation shaft 541 is located so as to extend in a direction in which the bottom wall 511 extends and has the first end portion 542 and a second end portion 543, at respective ends thereof. The first end portion 542 is rotatably supported by the shaft support portion 533 of the lid member 53. A cylindrical holding piece 544 is attached to the second end portion 543. A barrel portion 545 of the container gear 54G is inserted into the cylindrical holding piece 544, thereby integrating the container gear 54G with the rotation shaft 541. The barrel portion 545 is rotatably supported by the other end portion 524 (first shaft support portion) of the cylindrical portion 52. A flexible film member 546, through which toner is fed to the toner discharge port 521, is attached to a circumferential surface of the cylindrical holding piece 544 so as to extend in a direction perpendicular to the axial direction of the rotation shaft 541. The film member 546 revolves as the rotation shaft 541 rotates.

The first transportation member 55 is integrally formed with the rotation shaft 541 so as to extend from a circumferential surface of the rotation shaft 541 in a spiral shape. The second transportation member 56 is positioned around an outer circumference of the rotation shaft 541. The second transportation member 56 is a hollow spiral-shaped transportation member separated from the rotation shaft 541 with a gap therebetween and separated from the first transportation member 55 with a gap therebetween. The pair of dispersing members 57 each have a bar-like shape disposed parallel to the rotation shaft 541 and each connect side portions of components of the second transportation member 56 to one another.

In other words, the second transportation member 56 is formed of a plurality of arch-shaped transportation pieces, which are integrated by the pair of dispersing members 57. As a result, the second transportation member 56 having a hollow spiral shape is formed. The rotation shaft 541, which has the first transportation member 55 on the circumferential surface, is inserted into the hollow spiral of the second transportation member 56 in a concentric manner, thereby forming the rotating unit 54 of the present embodiment. The direction of the spiral of the first transportation member 55 is opposite to that of the second transportation member 56.

The pair of dispersing members 57 are connected to each other by connection piece 572 at end portions 571 thereof The central portion of the connection piece 572 is fastened to the rotation shaft 541 near the first end portion 542 of the rotation shaft 541. Although it is not illustrated in FIG. 10, a similar connection piece is located also on the second end portion 543 side. That is, the rotation shaft 541, the second transportation member 56, and the dispersing members 57 are integrated into a unit using the connection pieces 572. Thus, when the rotation shaft 541 rotates, the second transportation member 56 and the dispersing members 57 also rotate together with the rotation shaft 541.

The rotating unit 54 is positioned throughout a region from the main body 51 to the cylindrical portion 52. The rotating unit 54 has a first portion 54A, which is located in the main body 51, and a second portion 54B, which is located in the cylindrical portion 52. The first transportation member 55 extends substantially the entire length of the rotation shaft 541 in the axial direction of the rotation shaft 541. That is, the first transportation member 55 is positioned in both the first portion 54A and the second portion 54B. The second transportation member 56 is positioned only in an area corresponding to the first portion 54A of the rotation shaft 541. The dispersing members 57 are located in both the first portion 54A and the second portion 54B.

When a rotational drive force that rotates the rotation shaft 541 in a specified rotation direction is applied to the container gear 54G, forces that transport the toner are generated by the first transportation member 55 and the second transportation member 56 in accordance with the respective directions of the spirals. The second transportation member 56 transports toner so as to feed toner from the main body 51 toward the cylindrical portion 52 (toner discharge port 521). That is, the second transportation member 56 transports toner from the first end portion 542 side toward the second end portion 543 side of the rotation shaft 541. In contrast, the first transportation member 55 transports toner from the cylindrical portion 52 back toward the main body 51. That is, the first transportation member 55 transports toner from the second end portion 543 side toward the first end portion 542 side of the rotation shaft 541. The dispersing members 57 disperse toner, which is being transported by the first transportation member 55 and the second transportation member 56, in radial directions of the rotation shaft 541.

Toner fed to the cylindrical portion 52 by the second transportation member 56 is mainly moved in an area of the cylindrical portion 52 near an inner circumferential wall of the cylindrical portion 52 toward the other end portion 524. Part of the toner that reaches the other end portion 524 is pushed by the film member 546, thereby being discharged through the toner discharge port 521. In contrast, toner, which has not been discharged through the toner discharge port 521, is mainly moved near the central axis of the cylindrical portion 52 toward the one end portion 523 by the first transportation member 55. Also due to the dispersion of toner in the radial directions (direction toward the central axis) caused by the dispersing members 57, toner is returned to the main body 51.

As described above, the toner container 50 according to an embodiment has a circulating transportation function that causes toner having been fed to the cylindrical portion 52 by the second transportation member 56 to be moved back to the main body 51 using the first transportation member 55. Thus, clumps of toner in the toner discharge port 521 can be suppressed. That is, when a transportation function by which toner is transported only in a forward direction by the second transportation member 56 is provided and the amount of the toner to be discharged is relatively small compared to the amount of the toner transported, the toner in the cylindrical portion 52 having a limited space that cannot move, is packed inside the cylindrical portion 52, and finally is clumped. When this occurs, the toner discharge port 521 is clogged with clumped toner. This causes a problem in that the toner cannot be discharged. The toner container 50 according to an embodiment is provided with a transportation function that causes the first transportation member 55 to move toner in the reverse direction in the cylindrical portion 52, thereby preventing toner from being packed.

Next, the shape of the main body 51 will be described with reference mainly to FIGS. 11 and 12. The bottom wall 511 of the main body 51 has an inner surface 511A having a semi-circular shape in a section perpendicular to the rotation shaft 541. The inner surface 511A has a curved surface corresponding to a locus of rotation of the second transportation member 56, which is the furthest protruding portion of the rotating unit 54 in the radial direction. That is, the bottom wall 511 has the inner surface 511A, the radius of which is slightly larger than that of the spiral shape of the second transportation member 56. The second transportation member 56 is omitted from FIG. 11 for simplicity of illustration.

The first side wall 512 has an inner surface (first linear inner surface 512A) having a linear shape seen in a section perpendicular to the rotation shaft 541. Likewise, the second side wall 513 has an inner surface (second linear inner surface 513A) having a similar linear shape. Here, the rotation direction of the rotating unit 54 (rotation shaft 541) is counterclockwise as indicated by an arrow in FIG. 11. Thus, the first side wall 512 is positioned on an upstream side in the rotation direction of the rotation shaft 541, and the second side wall 513 is positioned on a downstream side in the rotation direction of the rotation shaft 541. Here, the upstream side refers to a side (right side in FIG. 11) on which the toner is transported from the base wall side toward the top wall side in the rotation direction of the rotation shaft 541. The downstream side refers to a side (left side in FIG. 11) on which the toner is transported from the top wall side toward the bottom wall side in the rotation direction of the rotation shaft 541.

In a section perpendicular to the rotation shaft 541, the first linear inner surface 512A extends upward from an end (right side in FIG. 11) of the semi-circular inner surface 511A along a tangent line of the inner surface 511A. In a section perpendicular to the rotation shaft 541, the second linear inner surface 513A extends upward from the other end (left side in FIG. 11) of the semi-circular inner surface 511A along a tangent line of the inner surface 511A. The distance between the first linear inner surface 512A and the second linear inner surface 513A increases from the bottom wall 511 toward an upper portion of the main body 51.

In the toner container 50 having the above-described shape, the inner surface 511A having a semi-circular shape is a curved surface, the radius of which is set to slightly larger than the radius of the spiral of the second transportation member 56. Thus, substantially the whole area on the bottom wall 511 serves as a toner transportation area of the rotating unit 54. Accordingly, toner on the bottom wall 511 can be efficiently transported by the rotating unit 54, thereby making it difficult for toner to remain on the bottom wall 511. In addition, an agitating paddle or the like that transports toner toward the rotating unit 54 is not needed as a separate component in the main body 51. This helps simplify the structure. The distance between the first linear inner surface 512A and the second linear inner surface 513A increases toward the upper portion of the main body 51. This allows the capacity of the main body 51 to be increased by an amount corresponding to the increase in the distance and allows toner to be reliably gathered on the rotating unit 54.

Although the first linear inner surface 512A is slightly inclined inward relative to the reference line V (toward a reference line V, which is a line perpendicular to a horizontal line that passes through the axis P of the rotation shaft 541) seen in a section perpendicular to the rotation shaft 541, the first linear inner surface 512A is substantially parallel to the reference line V. In contrast, the second linear inner surface 513A is comparatively largely inclined outward (in a direction away from the reference line V) relative to the reference line V seen in a section perpendicular to the rotation shaft 541. That is, a first angle θ1, which is formed between the reference line V and the first linear inner surface 512A, is less than a second angle θ2, which is formed between the reference line V and the second linear inner surface 513A. In the present embodiment, the first angle θ1=−3° and the second angle θ2=15°.

The above-described reference line V is a line defined when the toner container 50 is set in the replenishing position. In the replenishing position, the toner container 50 is oriented so as to replenish the developing device 33 (another device) with the toner. That is, the reference line V is a line perpendicular to the horizontal line that passes through the axis P of the rotation shaft 541 when the toner container 50 is normally connected to the developing device 33. Thus, the reference line V is not a line that is defined in the case where the toner container 50 is handled as an individual component, is oriented, for example, when on a horizontal surface and stationary. Instead, the reference line V is a line defined when the toner container 50 is connected to a target to be replenished and is in a replenishing position, or in the situation where the replenishing position is simulated. FIG. 11 illustrates the toner container 50 in the replenishing position.

In an embodiment, an example is described in which the reference line V extends through the axis P of the rotation shaft 541 and Ow, which is the center of the width W of the toner discharge port 521 in a section perpendicular to the rotation shaft 541. This arrangement is only an example, and the toner discharge port 521 may be arranged in an eccentric manner.

The first linear inner surface 512A, which is positioned on the upstream side in the rotational direction of the rotation shaft 541, is preferably substantially perpendicular to the horizontal plane. The first angle θ1 is preferably from −5 to 5 degrees. The second linear inner surface 513A, which is positioned on the downstream side in the rotational direction of the rotation shaft 541, is preferably inclined in a direction away from the reference line V in view of an increase in the capacity of the container. The second angle θ2 is preferably from 5 to 45 degrees.

Figure 12:
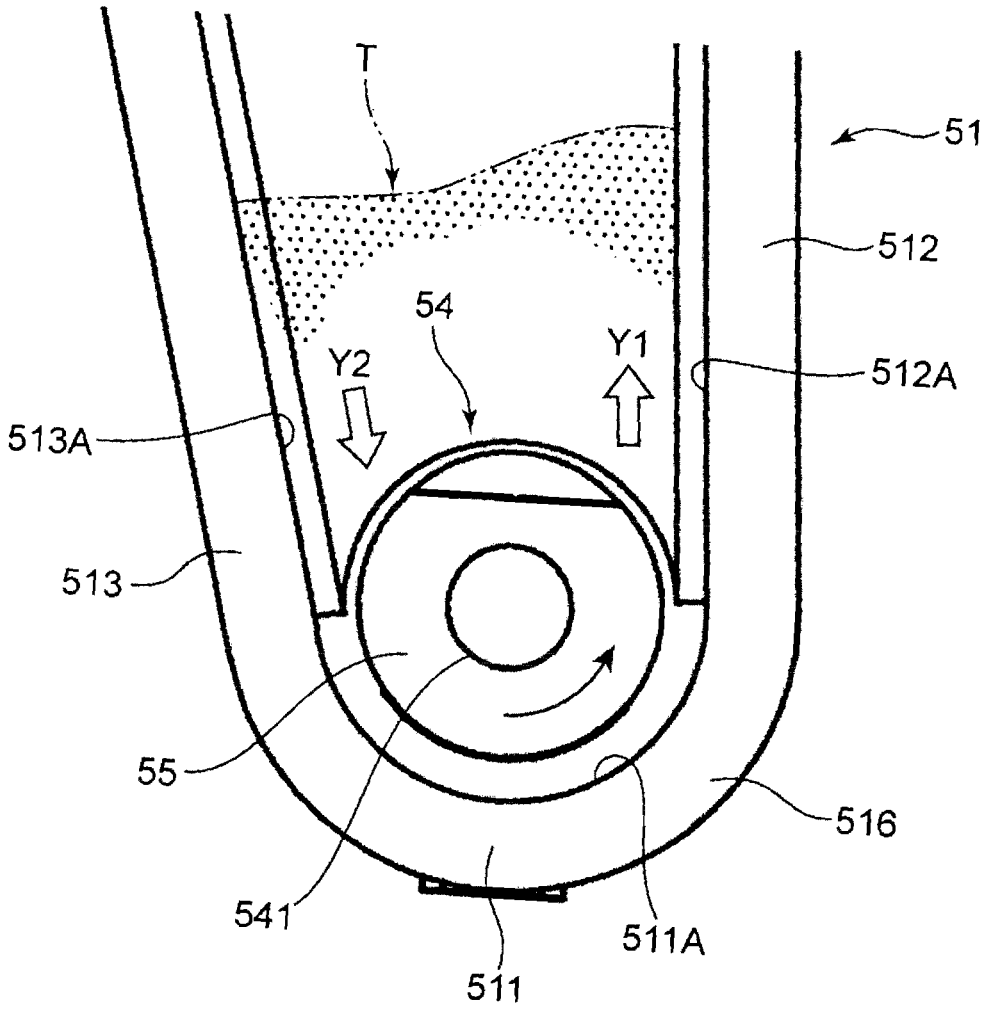
FIG. 12 is a diagram illustrating rotation of the rotating unit.

As illustrated in FIG. 12, when toner T is stored in the main body 51, the state of the toner T is such that the toner T covers over the rotating unit 54. When the rotation shaft 541 rotates counterclockwise, toner on the first linear inner surface 512A side is moved upward as indicated by arrow Y1. In contrast, as the rotation shaft 541 rotates, toner on the second linear inner surface 513A side is moved downward as indicated by arrow Y2.

As a result, if there is a large amount of toner on the first linear inner surface 512A side this may prevent a smooth rotation of the rotating unit 54. This increases the load on the rotating unit 54 and applies a large load to the drive device such as a motor that drives the rotating unit 54. Thus, the first angle θ1 is preferably from −5 to 5 degrees so as to reduce the weight of the toner applied to the rotating unit 54 on the upstream side in the rotation direction. If the first angle θ1 exceeds 5 degrees this will cause a large amount of the toner to exist on the first linear inner surface 512A side. If the first angle θ1 is less than −5 degrees this will decrease the capacity of the container.

The toner that exists on the second linear inner surface 513A side is moved downward due to the rotation of the rotating unit 54 and does not significantly affect rotation of the rotating unit 54. Thus, the second angle θ2 is preferably set to be greater than the first angle θ1, thereby ensuring the container has sufficient capacity. However, setting the angle of inclination of the second linear inner surface 513A to an angle less than the angle of repose for the toner contained in the toner container 50 is not preferable because this angle of inclination would reduce the toner reaching the bottom wall 511 and cause toner to adhere to and remain on the second linear inner surface 513A. In general, the angle of repose for the toner is 35 to 40 degrees relative to a horizontal plane. Thus, the second angle θ2 is preferably selected so that the second linear inner surface 513A is inclined relative to the horizontal plane at an angle greater than the angle of repose, and preferably, the second angle θ2 does not exceed 45 degrees. It is not preferably for the second angle θ2 to be less than 5 degrees since this would decrease the capacity of the container.

In the toner container 50 according to an embodiment, the main body 51 has sufficient capacity while toner can be supplied to the developing device 33 through the toner discharge port 521 with the amount of toner left in the main body 51 decreased as much as possible. In addition, a smooth rotation of the rotating unit 54 is not prevented.

In particular, the reference line V extends through the axis P of the rotation shaft 541 and Ow, which is the center of the width W of the toner discharge port 521 in a section perpendicular to the rotation shaft 541. Thus, inclinations of the first linear inner surface 512A and the second linear inner surface 513A are determined with reference to a position at which the toner is discharged. This allows the rotating unit 54 to rotate while effects caused by toner are further reduced.

Although the toner container 50 and the image forming apparatus 1 according to an embodiment of the present disclosure have been described above, the present disclosure is not limited to this and the embodiment may be modified, for example, as follows.

(1) In the above-described embodiment, an example of the toner container 50 includes the main body 51 and the cylindrical portion 52, which extends from the main body 51. However, the toner container 50 is not necessarily provided with the cylindrical portion 52. The toner discharge port 521 may be located on an end side of the bottom wall 511 of the main body 51.

(2) In the above-described embodiment, an example of the rotating unit 54 includes the first transportation member 55, the second transportation member 56, and a pair of dispersing members 57. The first transportation member 55 and the second transportation member 56 transport toner in opposite directions. Instead, a rotating unit that transports toner in a single direction in which the toner is moved toward the toner discharge port 521 may be used.

(3) In the above described embodiment, an example is described in which both of the first side wall 512 and the second side wall 513 have linear inner surfaces (first linear inner surface 512A and the second linear inner surface 513A) through the entire length thereof in the up-down direction. Alternatively, upper portions of the first side wall 512 and the second side wall 513 may be inner surfaces that are not inclined at the above-described first angle θ1 and the second angle θ2. For example, the upper portion of the second side wall 513 may be perpendicular to the horizontal plane. Alternatively, the inner surfaces of the first side wall 512 and the second side wall 513 may be gently curved.

(4) In the above-described embodiment, the toner container 50 is described as a specific example of a developer case. The developer case may instead be, for example, a developing unit into which a toner storage unit, developing roller, and so forth are integrated, an intermediate hopper disposed between the toner container and the developing device, or the like.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A developer case that contains developer and supplies developer to another device in a specified replenishing position, the developer case comprising:

a main body that includes a bottom wall, a top wall, and a first side wall and a second side wall that connect end portions of the bottom wall to corresponding end portions of the top wall in a straight line; and a rotating unit located above the bottom wall in the main body, the rotating unit transports the developer, the rotating unit includes a rotation shaft that extends in a same direction as the bottom wall extends, a transportation member positioned in an outer circumference of the rotation shaft, the transportation member rotating together with the rotation shaft, and a drive input member to which a drive force that rotates the rotation shaft in a specified rotation direction about an axis is inputted, wherein, in a section perpendicular to the rotation shaft, the bottom wall has an inner surface having a semi-circular shape corresponding to a locus of rotation of a radially furthest extending portion of the transportation member, and the first side wall and the second side wall respectively have a first linear inner surface and a second linear inner surface, the first linear inner surface and the second linear inner surface linearly extending in an up-down direction;

the first linear inner surface and the second linear inner surface each extend upward along a tangent line of the semi-circular inner surface of the bottom wall in a straight line from the bottom wall toward the top wall;

the first side wall is positioned on an upstream side in a rotation direction of the rotating unit, the second side wall is positioned on a downstream side in the rotation direction of the rotating unit, and a distance between the first linear inner surface and the second linear inner surface increases from the bottom wall side toward the top wall; and when the developer case is in the replenishing position, when a line perpendicular to a horizontal line that passes through the axis of the rotation shaft is defined as a reference line, a first angle θ1 formed between the reference line and the first linear inner surface is less than a second angle θ2 formed between the reference line and the second linear inner surface.

2. The developer case according to claim 1, comprising:

a discharge port located in the bottom wall through which the developer contained in the main body can be discharged, wherein the reference line extends through the axis of the rotation shaft and a center in a width direction of the discharge port in the section perpendicular to the rotation shaft.

3. The developer case according to claim 1, wherein the first angle θ1 is such that the first linear inner surface is substantially perpendicular to a horizontal plane, and the second angle θ2 is such that the second linear inner surface is inclined relative to the horizontal plane at an angle greater than an angle of repose for the developer.

4. The developer case according to claim 3, wherein the first angle θ1 is more than −5 and less than 5 degrees, and wherein the second angle θ2 is from 5 to 45 degrees.

5. The developer case according to claim 1, wherein the main body includes a third side wall that connects an end side of the first side wall to an end side of the second side wall, and a fourth side wall that connects another end side of the first side wall to another end side of the second side wall, a cylindrical portion extends from the third side wall, the cylindrical portion being continuous with the bottom wall, the cylindrical portion having a discharge port formed in a lower surface thereof, and part of the rotating unit extends into the cylindrical portion, and the rotation shaft is rotatably supported by a first shaft support portion positioned in the cylindrical portion and a second shaft support portion positioned in the fourth side wall.

6. The developer case according to claim 1, wherein the rotating unit is located parallel to the rotation shaft and includes at least one dispersing member that contacts the transportation member.

7. The image forming apparatus of claim 1, wherein a distance between the first linear inner surface and the reference line reduces from the bottom wall side toward the top wall side; and wherein a distance between the second linear inner surface and the reference line increases from the bottom wall side toward the top wall side.

8. An image forming apparatus comprising:

an image carrying body that carries a developer image on a circumferential surface thereof;

a developing device that supplies developer to the image carrying body; and a developer case removably connected to the developing device, the developing device being replenished with the developer from the developer case, wherein the developer case includes a main body that includes a bottom wall, a top wall, and a first side wall and a second side wall that connect end portions of the bottom wall to corresponding end portions of the top wall in a straight line, and a rotating unit located above the bottom wall in the main body, the rotating unit transports the developer, the rotating unit including a rotation shaft that extends in a same direction as the bottom wall extends, a transportation member disposed in an outer circumference of the rotation shaft, the transportation member rotating together with the rotation shaft, and a drive input member to which a drive force that rotates the rotation shaft in a specified rotation direction about an axis is inputted, and wherein, in a section perpendicular to the rotation shaft, the bottom wall has an inner surface having a semi-circular shape corresponding to a locus of rotation of a radially furthest extending portion of the transportation member, and the first side wall and the second side wall respectively have a first linear inner surface and a second linear inner surface, the first linear inner surface and the second linear inner surface linearly extending in an up-down direction;

the first linear inner surface and the second linear inner surface each extend upward along a tangent line of the semi-circular inner surface of the bottom wall in a straight line from the bottom wall toward the top wall;

the first side wall is positioned on an upstream side in a rotation direction of the rotating unit, the second side wall is positioned on a downstream side in the rotation direction of the rotating unit, and a distance between the first linear inner surface and the second linear inner surface increases from the bottom wall side toward an upper portion of the main body; and when the developer case is in a replenishing position where the developer case supplies the developer to the developing device, when a line perpendicular to a horizontal line that passes through the axis of the rotation shaft is defined as a reference line, a first angle θ1 formed between the reference line and the first linear inner surface is less than a second angle θ2 formed between the reference line and the second linear inner surface.

9. The image forming apparatus according to claim 8, wherein the developing device includes a developing roller that supplies the developer to the circumferential surface of the image carrying body, and a developing housing having a shape that is elongated in a first direction, the first direction being a direction in an axial direction of the developing roller, and the developer case is connected to the developing device such that the rotation shaft is oriented in a second direction, the second direction being a direction perpendicular to the first direction.

10. The image forming apparatus according to claim 9, wherein the developer case is removably connected to the developing device in the second direction.

11. The image forming apparatus according to claim 8, wherein the developer case includes a discharge port located in the bottom wall through which the developer contained in the main body can be discharged, and wherein the reference line extends through the axis of the rotation shaft and a center in a width direction of the discharge port in the section perpendicular to the rotation shaft.

12. The image forming apparatus according to claim 8, wherein the first angle θ1 is such that the first linear inner surface is substantially perpendicular to a horizontal plane, and the second angle θ2 is such that the second linear inner surface is inclined relative to the horizontal plane at an angle greater than an angle of repose for the developer.

13. The image forming apparatus according to claim 12, wherein the first angle θ1 is more than −5 and less than 5 degrees, and wherein the second angle θ2 is from 5 to 45 degrees.

14. The image forming apparatus according to claim 8, wherein the main body includes a third side wall that connects an end side of the first side wall to an end side of the second side wall, and a fourth side wall that connects another end side of the first side wall to another end side of the second side wall, a cylindrical portion extends from the third side wall, the cylindrical portion being continuous with the bottom wall, the cylindrical portion having a discharge port formed in a lower surface thereof, and part of the rotating unit extends into the cylindrical portion, and the rotation shaft is rotatably supported by a first shaft support portion positioned in the cylindrical portion and a second shaft support portion positioned in the fourth side wall.

15. The image forming apparatus according to claim 8, wherein the rotating unit is located parallel to the rotation shaft and includes at least one dispersing member that contacts the transportation member.

* * * * *